US007352383B2

(12) United States Patent
Fukuyo

(10) Patent No.: US 7,352,383 B2
(45) Date of Patent: Apr. 1, 2008

(54) THERMAL PRINTER

(75) Inventor: Masakazu Fukuyo, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 129 days.

(21) Appl. No.: 11/478,681

(22) Filed: Jul. 3, 2006

(65) Prior Publication Data

US 2007/0002123 A1 Jan. 4, 2007

(30) Foreign Application Priority Data

Jul. 1, 2005 (JP) ..... 2005-193406

(51) Int. Cl.
*B41J 2/315* (2006.01)

(52) U.S. Cl. ..... 347/221

(58) Field of Classification Search ..... 347/221, 347/215, 198, 174, 171; 346/136
See application file for complete search history.

(56) References Cited

U.S. PATENT DOCUMENTS 4,839,674 A * 6/1989 Hanagata et al. ..... 346/136
7,283,147 B2 * 10/2007 Sago et al. ..... 347/198
2002/0057325 A1 * 5/2002 Kapushinski et al. ..... 347/174

FOREIGN PATENT DOCUMENTS

JP 2002-292953 A 10/2002

* cited by examiner

*Primary Examiner*—K. Feggins
(74) *Attorney, Agent, or Firm*—Sughrue Mion, PLLC

(57) ABSTRACT

A thermal printer includes a thermal head which has heating elements arranged in a main scanning direction, a transport unit for transporting a thermal recording material in a sub scanning direction perpendicular to the main scanning direction and a skewing unit for skewing the thermal recording material so that its ends in the main scanning direction form an angle with respect to the sub scanning direction at a predetermined recording position. The thermal recording material that has been skewed so that its ends form the angle is supplied to the recording position, and the thermal recording on the thermal recording material is performed with the thermal head while the thermal recording material that remains skewed is transported in the sub scanning direction.

9 Claims, 6 Drawing Sheets

THERMAL PRINTER

The entire content of a document cited in this specification is incorporated herein by reference.

BACKGROUND OF THE INVENTION

The present invention belongs to a technical field of thermal printers. More specifically, the present invention relates to a thermal printer capable of preventing dirt from adhering to specified positions of a thermal head.

Thermal printers have been conventionally employed to record small images such as those for ultrasonography on a thermal recording material (hereinafter referred to simply as a recording material) having a thermal recording layer formed on a support made of a film or the like.

The thermal printers have advantages such as the unnecessity of wet processing and simple handling, and hence have been also employed recently to record images for the purpose of diagnoses requiring high-quality large images, as exemplified by CT (Computerized Tomography), MRI (Magnetic Resonance Imaging) and radiography.

The thermal printers each use a thermal head having heating elements arranged in a line to thereby perform thermal recording. More specifically, the thermal head and a recording material are moved relative to each other in a direction perpendicular to a main scanning direction in which the heating elements are arranged, with the heating elements of the thermal head slightly pressed against the recording material, and energy is applied to each of the heating elements in accordance with an image to be recorded to heat a thermal recording layer of the recording material imagewise to thereby perform the thermal recording.

The recording material for use in the thermal recording is usually in the form of cut sheets with a predetermined size which are obtained by cutting. There are many cases where the thermal recording layer is exposed or warped in the lateral edge surfaces (edges in the main scanning direction) of cut sheets owing to the cutting of the recording material.

Therefore, the thermal recording very often causes the thermal recording layer exposed in the lateral edge surfaces of the cut sheets of the recording material to directly come into contact with the thermal head, whereby dirt is most likely to adhere to the thermal head. In general, the thermal printers perform the thermal recording by using a recording material of a single size or recording materials of several predetermined sizes. As a result, every time the thermal recording is repeatedly performed, the exposed thermal recording layer comes into contact with a specified portion of the thermal head and dirt is deposited onto the specified portion of the thermal head, which causes a decrease in the heat transfer to the heating elements positioned in the specified portion, resulting in a reduction of the color optical density on these heating elements.

As a result of the thermal recording performed in such a condition, portions recorded by the heating elements have reduced color optical densities and are made unclear, so that a finished image has streaky density unevenness.

Compared with thermal printers capable of printing on a recording material of a single size, in thermal printers capable of printing on recording materials of two or more sizes, the positions at which the lateral edges of the recording material come into contact with the thermal head particularly vary depending on the size of the recording material used.

In thermal printers capable of printing on recording materials of two or more sizes, dirt adheres to several portions on the thermal head depending on the recording material used. Therefore, in the case where the recording is performed with a large-sized recording material, there is a possibility that streaky density unevenness occurs not in the end portions of an image but in its important portions, which will pose a serious problem.

JP 2002-292953 A discloses a thermal printer which has a moving means for moving a thermal head and a recording material relative to each other in a main scanning direction at least by a length corresponding to one pixel, namely a recording material guide for shifting the transport path of the recording material in the main scanning direction, and in which the position at which the recording material comes into contact with the thermal head is changed with the moving means every time printing is carried out. This printer enables the frequency of contact between the lateral edges of cut sheets of the recording material and a specified portion of the thermal head to be reduced, and thus prevents concentrated adhesion of dirt to the specified portion of the thermal head.

SUMMARY OF THE INVENTION

Although the thermal printer disclosed in JP 2002-292953 A can reduce the frequency of contact between the lateral edge surfaces of cut sheets of a recording material and specified heating elements, the thermal printer that must have the moving means such as the recording material guide involves increases in the size and production cost.

An object of the present invention is to provide a thermal printer capable of reducing the frequency of contact between a thermal recording layer exposed in the lateral edge surfaces of cut sheets of a recording material and a specified portion of a thermal head without causing an increase in the production cost or the apparatus size, whereby dirt is prevented from adhering to the specified portion of the thermal head to enable a high-quality image to be recorded without causing streaky density unevenness due to a decrease of the color optical density on the specified portion of the thermal head.

In order to attain the object described above, there is provided a thermal printer comprising: a thermal head which has heating elements arranged in a main scanning direction; transport means for transporting a thermal recording material in a sub scanning direction perpendicular to the main scanning direction; and skewing means for skewing said thermal recording material so that its ends in the main scanning direction form an angle with respect to the sub scanning direction at a predetermined recording position, wherein said thermal recording material having been skewed by said skewing means so that its ends in the main scanning direction form said angle with respect to the sub scanning direction is supplied to said recording position, where thermal recording on said thermal recording material is performed with said thermal head while said thermal recording material which remains skewed is transported in the sub scanning direction by said transport means.

It is preferable in the present invention that the thermal printer further comprise detection means for detecting the ends of said thermal recording material in the main scanning direction, and that the recording position on said thermal recording material be controlled based on detection results obtained by the detection means.

It is also preferable in the present invention that a distance in the main scanning direction between a position at which a forward corner of one of the ends of said thermal recording material passes under the arranged heating elements and a position at which a rear corner thereof passes under the arranged heating elements be at least 1 mm.

It is further preferable in the present invention that the thermal printer further comprise a loading section for loading said thermal recording material, and that said skewing means load said thermal recording material into the loading section obliquely with respect to the sub scanning direction to supply the thermal recording material to said recording position with its ends in the main scanning direction skewed with respect to the sub scanning direction.

It is still further preferable in the present invention that said loading section include a generally rectangular magazine in which rectangular sheets of the thermal recording material are obliquely accommodated and an inlet for loading said magazine parallel to said sub scanning direction, and that said skewing means skew said thermal recording material to be accommodated in said magazine so that its ends in the main scanning direction are skewed with respect to the sub scanning direction when said magazine is loaded through said inlet.

It is yet further preferable in the present invention that said loading section include a generally rectangular magazine in which rectangular sheets of the thermal recording material are properly accommodated without being skewed and an inlet for loading said magazine in a skewed state, and that said skewing means load said magazine through said inlet in the skewed state so that the ends in the main scanning direction of said thermal recording material accommodated in said magazine are skewed with respect to the sub scanning direction.

It is still yet further preferable in the present invention that the thermal printer further comprise holding means which holds the thermal recording material at a point outwardly deviated from its center in the main scanning direction and which is provided midway along a transport path of the thermal recording material extending to said recording position, and which said skewing means use said holding means to temporarily hold said thermal recording material being transported by said transport means to supply said thermal recording material to said recording position with its ends in the main scanning direction skewed with respect to the sub scanning direction.

It is still yet further preferable in the present invention that a transport guide which regulates a position of said thermal recording material in the main scanning direction and which guides said thermal recording material in the sub scanning direction be further provided midway along the transport path of said thermal recording material extending to said recording position, that at least a part of said transport guide be movable in said main scanning direction toward a center of the transport path, and that said skewing means move said at least a part of the transport guide in said main scanning direction toward the center of the transport path to move on said transport path a portion near a forward end or rear end of said thermal recording material being transported on said transport path so that said thermal recording material is supplied to said recording position with its ends in the main scanning direction skewed with respect to the sub scanning direction.

In order to attain the object described above, there is also provided a thermal printer comprising: a thermal head which has heating elements arranged in a main scanning direction, wherein thermal recording is performed on a thermal recording material with said thermal head while transporting said thermal recording material in a sub scanning direction perpendicular to the main scanning direction at a predetermined recording position, wherein said thermal recording material having been skewed so that its ends in the main scanning direction form an angle with respect to the sub scanning direction at a predetermined recording position is supplied to said recording position, and wherein the thermal recording on said thermal recording material is performed with said thermal head while said thermal recording material which remains skewed is transported in the sub scanning direction.

Irrespective of whether a recording material of a single size or more than one size is used, the thermal printer of the present invention can reduce the frequency of contact between the lateral edge surfaces of cut sheets of a recording material and a specified portion of the thermal head without increasing the apparatus size and production cost, thereby preventing dirt from adhering to the specified portion of the thermal head. Therefore, the thermal printer of the present invention can minimize the decrease of the color optical density on a specified portion of the thermal head that may be caused by the adhesion of dirt to the specified portion of the thermal head, thus enabling a high-quality image to be recorded without causing streaky density unevenness due to the decrease of the color optical density.

DESCRIPTION OF THE PREFERRED EMBODIMENTS

The thermal printer of the present invention will be described below in detail based on preferred embodiments shown in the accompanying drawings.

Figure 1:
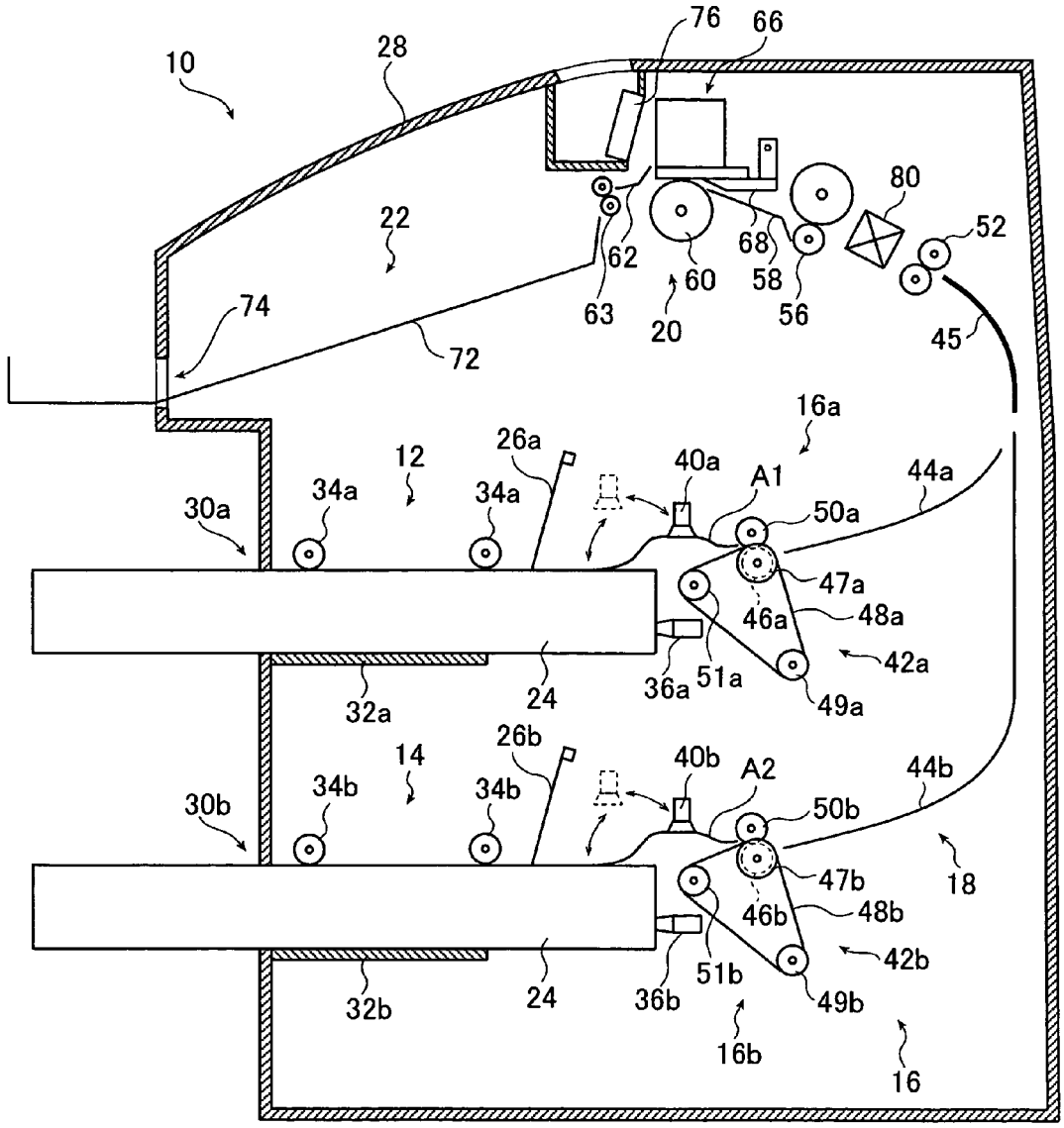
FIG. 1 is a schematic view showing the configuration of a thermal printer according to an embodiment of the present invention.

FIG. 1 is a schematic cross-sectional view showing the configuration of a thermal printer 10 according to an embodiment of the present invention.

In the thermal printer 10 of the present invention, thermal recording is performed with a thermal head 66 on a thermal recording material A cut into sheets of a predetermined size (hereinafter referred to simply as a recording material A). The thermal printer 10 includes a first loading section 12 and a second loading section 14 into which magazines 24 containing the recording material A are loaded, a supply/transport section 16, a recording section 20 in which the thermal head 66 performs thermal recording on the recording material A and a discharge section 22.

As in a usual thermal printer, the illustrated thermal printer 10 performs thermal recording by heating individual heating elements in accordance with an image to be recorded while the thermal head 66 and the recording material A are transported relative to each other in a sub scanning direction perpendicular to a main scanning direction in which the heating elements of the thermal head 66 are arranged, with the thermal head 66 pressed against the recording material A.

In the thermal printer 10 of the present invention, the recording material A is transported in the sub scanning direction with its ends in the main scanning direction (hereinafter referred to as the lateral edges) skewed (at an angle) with respect to the sub scanning direction (transport direction), and is supplied to a predetermined recording position where thermal recording is performed with the thermal head 66.

The first and second loading sections 12, 14 are each the section into which the magazine 24 containing the recording material A is loaded. The magazine 24 is a casing having a cover 26*a* or 26*b* which can be opened or closed as desired.

The recording material A is obtained by forming a thermal recording layer on the entire surface of a support made of a film such as a transparent polyethylene terephthalate (PET) film or paper. Typically, such thermal sheets A are stacked in a specified number, say, 100 to form a bundle, which is either wrapped in a bag or bound with a band to provide a package. The thermal sheets stacked in the specified number are accommodated in the magazines 24 with their thermal recording layers facing down.

In the illustrated case, the recording material A is accommodated in each of the magazines 24 with the lateral edges skewed with respect to the transport direction and is supplied to the recording position with its lateral edges skewed with respect to the sub scanning direction.

The first loading section 12 into which the magazine 24 is loaded includes an inlet (slot) 30*a* formed in a housing 28 of the thermal printer 10 of the present invention, a guide plate 32*a*, two guide rolls 34*a* and a stop member 36*a*. On the other hand, the second loading section 14 also includes an inlet (slot) 30*b* formed in the housing 28, a guide plate 32*b*, two guide rolls 34*b* and a stop member 36*b*.

The first and second loading sections 12, 14 are basically configured in the same manner, so the first loading section 12 will be taken as a typical example in the following description.

The guide plate 32*a* (32*b*) supports the lower surface of the loaded magazine 24. The guide rolls 34*a* (34*b*) and the guide plate 32*a* hold the upper and lower surfaces of the magazine 24, respectively, for the vertical positioning of the magazine 24.

The magazine 24 is inserted through the inlet 30*a* (30*b*) into the thermal printer 10 with the cover 26*a* (26*b*) side facing forward and is guided by the guide plate 32*a* (32*b*) and the guide rolls 34*a* (34*b*) to the position at which the magazine 24 comes in contact with the stop member 36*a* (36*b*). The magazine 24 is thus loaded into the thermal printer 10 to be held at a specified position.

The illustrated thermal printer 10 can perform thermal recording on the recording materials A of two sizes.

Therefore, images can be recorded on the recording materials A of different two sizes without the necessity of magazine replacement by providing the thermal printer with the loading sections (i.e., first loading section 12 and second loading section 14) and loading therein the magazines 24 containing the recording materials A which are different in size from each other.

In the illustrated case, the magazines 24 loaded into the first and second loading sections 12, 14 contain, for example, a large-sized recording material A1 and a small-sized recording material A2, respectively.

In the illustrated case, the supply/transport section 16 includes a first supply/transport subsection 16*a* for the first loading section 12, a second supply/transport subsection 16*b* for the second loading section 14, a transport guide 45, and a transport roller pair 52. The first and second support/transport subsections 16*a*, 16*b* are both the sites where the recording material A is taken out of the magazines 24 and transported to the recording section 20.

The first and second supply/transport subsections 16*a*, 16*b* are basically configured in the same manner. The subsection 16*a* (16*b*) includes a sheet feeding mechanism using a sucker 40*a* (40*b*), transport means 42*a* (42*b*) and a transport guide 44*a* (44*b*).

The sheet feeding mechanism (not shown) uses the sucker 40*a* (40*b*) to take the recording material A out of the magazine 24 loaded into the loading section. The transport means 42*a* (42*b*) includes a transport roller 46*a* (46*b*), a pulley 47*a* (47*b*) coaxial with the transport roller 46*a* (46*b*), a pulley 49*a* (49*b*) connected with a rotary drive source (not shown), a tension pulley 51*a* (51*b*), an endless belt 48*a* (48*b*) stretched around the three pulleys and a nip roller 50*a* (50*b*) pressed onto the transport roller 46*a* (46*b*). The forward end of the recording material A which has been sheet-fed by means of the sucker 40*a* (40*b*) is nipped and transported between the transport roller 46*a* (46*b*) and the nip roller 50*a* (50*b*). The transport guide 44*a* (44*b*) guides the supplied recording material A to the transport guide 45 located downstream.

The transport guide 45 guides the recording material A having been transported by the first and second supply/transport subsections 16*a*, 16*b* to the transport roller pair 52.

Further, the transport roller pair 52 transports the recording material A having been transported by the first and second supply/transport subsections 16*a*, 16*b* to the recording section 20 as it is guided by the transport guide 45.

Figure 2:
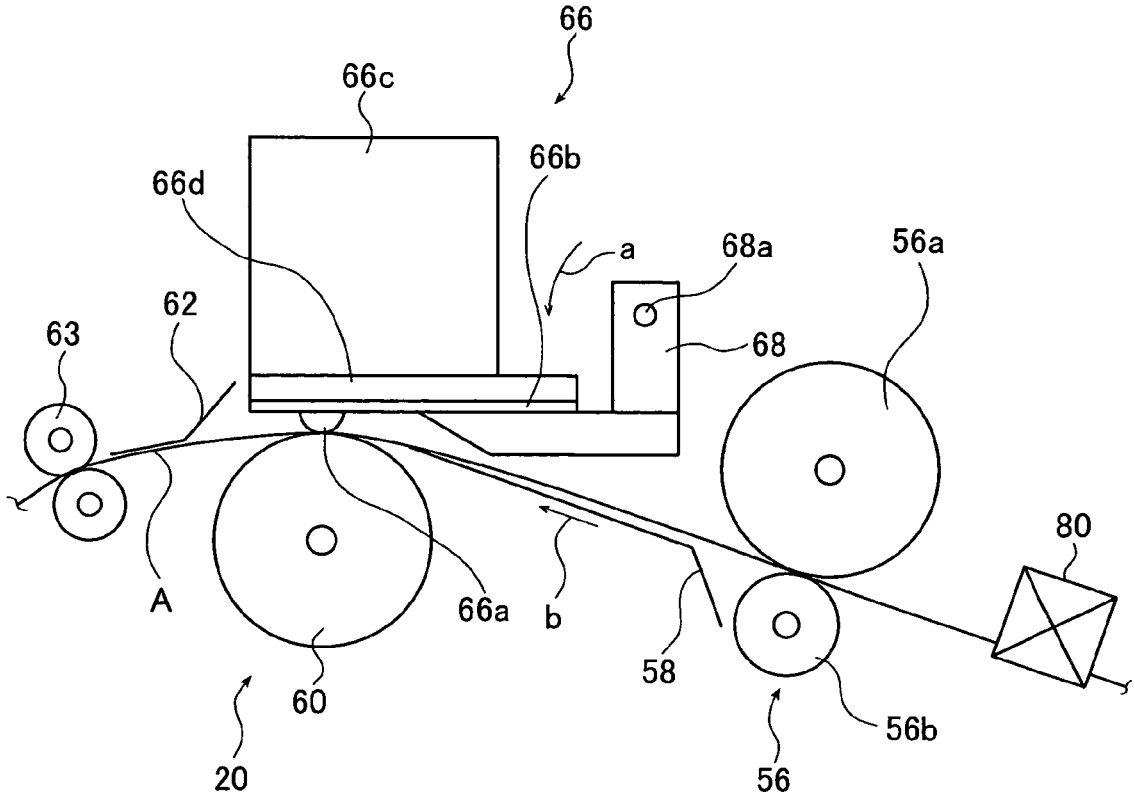
FIG. 2 is a schematic view showing a recording section of the thermal printer shown in FIG. 1.

FIG. 2 schematically shows the recording section 20. The recording section 20 includes a line sensor 80, the thermal head 66, a platen roller 60, a cleaning roller pair 56, a cooling fan 76 (see FIG. 1) for cooling the thermal head 66, guides 58, 62 and a transport roller pair 63.

The line sensor 80 is a well known line sensor that is provided between the transport roller pair 52 and the cleaning roller pair 56 and detects the positions of the lateral edges of the recording material A to be supplied to the thermal head 66. Based on the detection result of the lateral edges of the recording material A as obtained by the line sensor 80, the illustrated thermal printer 10 actuates only the heating elements in the area corresponding to the inside of the lateral edges of the recording material A to perform thermal recording, which positively prevents useless heating of the heating elements. The line sensor 80 is movable in the main scanning direction so that the lateral edges of the recording materials A of two or more sizes can be detected by moving the line sensor 80 in accordance with the size of the recording material A used.

The line sensor 80 is not the sole means for detecting the lateral edges of the recording material A in the present invention, and various detection means used in common thermal printers can be used.

The thermal head 66 is capable of thermal recording at a recording (pixel) density of, say, about 300 dpi. The thermal head 66 includes a ceramic substrate 66*b* which is made of a highly heat-resistant, electrical insulating material such as alumina ceramic and in which a glaze 66*a* that has a large number of heat-generating resistors serving as the heating elements for thermal recording on the recording material A and arranged in one direction (in the direction perpendicular to the paper plane in FIGS. 1 and 2) is formed; the glaze 66*a* of the ceramic substrate 66*b*; a base 66*d*; and a heat sink 66*c* which is fixed onto the other surface of the base 66*d*, has a large number of radiation fins, and is made of a metal such as aluminum. The thermal head 66 is supported on a support member 68 that can pivot about a fulcrum 68*a* either in the direction of arrow "a" or in the reverse direction.

The platen roller 60 rotates at a predetermined recording speed while regulating the recording material A in a predetermined position, whereby the recording material A is transported in the direction (indicated by "b" in FIG. 2) perpendicular to the main scanning direction.

The cleaning roller pair 56 is a roller pair including an adhesive rubber roller 56*a* made of an elastic material and an ordinary roller 56*b*. The adhesive rubber roller 56*a* picks up dirt and other foreign matter that has adhered to the thermal recording layer of the recording material A, thereby preventing the dirt from adhering to the glaze 66*a* or otherwise adversely affecting the image recording operation.

The operation of the thermal printer 10 of the present invention will be described below.

The illustrated thermal printer 10 performs thermal recording in the same manner irrespective of whether the recording material A used in the thermal recording is a large-sized recording material A1 or a small-sized recording material A2. The case where the thermal recording is performed with the large-sized recording material A1 will be described below as a typical example.

When a command for THERMAL RECORDING START is issued, the cover 26*a* of the magazine 24 is opened by a opening/closing mechanism and the sucker 40*a* sucks up a sheet of the large-sized recording material A1 to supply its forward end to the transport means 42*a* (between the transport roller 47*a* and the nip roller 50*a*). As described above, the large-sized recording material A1 is accommodated in the magazine 24 with its lateral edges skewed with respect to the transport direction (sub scanning direction). Upon nipping of the sheet of the large-sized recording material A1 between the transport roller 47*a* and the nip roller 50*a*, the sucker 40*a* releases the sheet of the large-sized recording material A1.

The sheet of the large-sized recording material A1 is guided by the transport guides 44*a* and 45 to be transported to the transport roller pair 52. As soon as the sheet of the large-sized recording material A1 to be used for recording is completely taken out of the magazine 24, the opening/closing mechanism closes the cover 26*a*.

When the forward end of the sheet of the large-sized recording material A1 reaches the transport roller pair 52, the temperature of the thermal head 66 is checked. During this operation, the sheet of the large-sized recording material A1 is transported by the transport roller pair 52 without interruption and passes through the line sensor 80 to be transported to the thermal head 66. In this process, the line sensor 80 detects the lateral edges of the sheet of the large-sized recording material A1.

Before the sheet of the large-sized recording material A1 is transported to the recording section 20 in the thermal printer 10 of the present invention, the support member 68 pivots upward (in the direction opposite to the direction indicated by "a") so that the thermal head 66 (or its glaze 66*a*) is not in contact with the platen roller 60.

When the transport with the transport roller pair 52 starts, the sheet of the large-sized recording material A1 passes through the line sensor 80, is nipped in the cleaning roller pair 56 and is guided by the guide 58 to be transported to the recording position (position where the sheet is nipped between the thermal head 66 (glaze 66*a*) and the platen roller 60 while being transported).

When the sheet of the large-sized recording material A1 reaches the recording start position, the support member 68 pivots in the direction indicated by "a" so that the sheet of the large-sized recording material A1 is nipped between the glaze 66*a* of the thermal head 66 and the platen roller 60 with the glaze 66*a* pressed onto the recording layer. The sheet of the large-sized recording material A1 is transported by the platen roller 60 (as well as the transport roller pairs 52, 63) in the sub scanning direction indicated by "b" while being regulated in the predetermined position. The sheet of the large-sized recording material A1 is transported for scanning with its lateral edges skewed with respect to the sub scanning direction.

Along with the transport, the heating elements of the thermal head 66 are actuated in accordance with an image to be recorded to perform thermal recording on the sheet of the large-sized recording material A1. The thermal head 66 is actuated based on the detection result of the lateral edges of the sheet of the large-sized recording material A1 as obtained by the line sensor 80 so that recording is made only with the heating elements in the area corresponding to the inside of the lateral edges of the sheet of the large-sized recording material A1, which positively prevents useless heating of the heating elements of the thermal head 66.

After the end of the thermal recording, the sheet of the large-sized recording material A1 is transported by the platen roller 60 and the transport roller pair 63 as it is guided by the guide 62 and is discharged into a tray 72 of the discharge section 22. The tray 72 protrudes outside the thermal printer 10 through an outlet 74 formed in the housing 28. The sheet of the large-sized recording material A1 having an image recorded thereon is discharged outside through the outlet 74 to be taken by an operator.

As described above, the thermal printer 10 of the present invention supplies the recording material A to the recording position with its lateral edges skewed (at an angle) with respect to the sub scanning direction and performs thermal recording as it is transported in the sub scanning direction. The sequential movement of the recording material A skewed and transported is shown in FIG. 3.

As described above, the recording material A is accommodated in the magazine 24 with its lateral edges in the main scanning direction skewed with respect to the sub scanning direction. Any known positioning method used in accommodating sheets in a case, as exemplified by a method in which a partition for regulating the position of the recording material A is obliquely disposed can be employed for the method of obliquely accommodating the recording material A in the magazine 24. As in common thermal printers, the magazines 24 are loaded straight into the first and second loading sections 12, 14 of the thermal printer 10 through the inlets 30*a*, 30*b*, respectively. The respective inlets 30*a*, 30*b* of the first and second loading sections 12, 14 and the magazines 24 loaded into these loading sections 12, 14 through the inlets 30*a*, 30*b* constitute means for skewing the recording material A according to the present invention.

Figure 3:
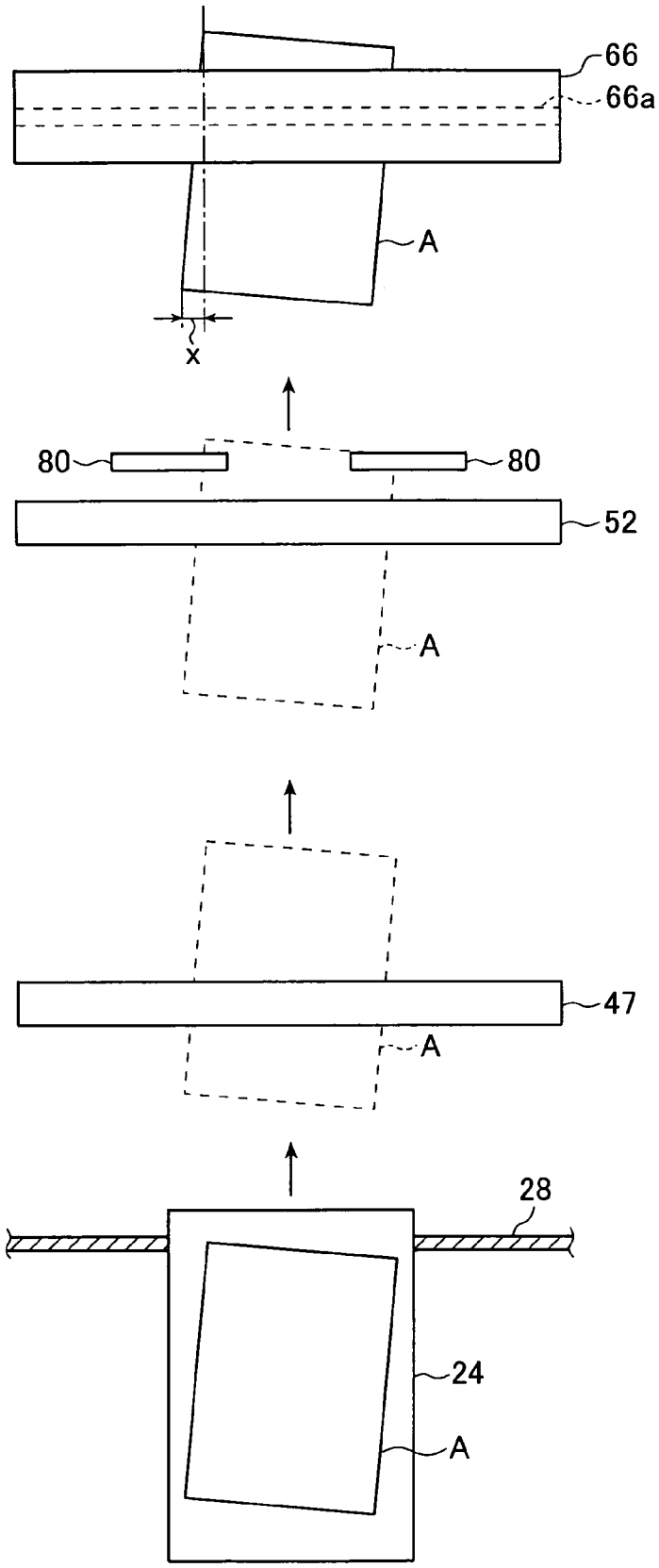
FIG. 3 is a plan view illustrating an example of the sequential movement of a thermal recording material skewed and transported in the thermal printer of the present invention.

Therefore, as shown in FIG. 3, the recording material A is disposed in the magazine 24 with its lateral edges skewed with respect to the respective transport rollers and the thermal head 66 (platen roller 60), in other words, with respect to the sub scanning direction.

When a command for THERMAL RECORDING START is issued, the sucker 40*a* (not shown in FIG. 3) sucks up a sheet of the recording material A accommodated obliquely with respect to the transport direction and supplies it to the transport roller 46*a* as it is.

The sheet of the recording material A that remains skewed is transported to the transport roller pair 52 and is further transported through the transport roller pair 52 and the positions of its lateral edges (ends in the direction perpendicular to the transport direction) are detected by the line sensor 80.

The sheet of the recording material A having passed through the line sensor 80 is cleaned by the cleaning roller pair 56 (not shown in FIG. 3) while being transported to the platen roller 60 by the cleaning roller pair 56, and as described above, thermal recording is performed at the predetermined recording position on the sheet which is nipped and transported between the platen roller 60 and the thermal head 66. In the thermal printer 10 in this embodiment of the present invention, the recording material A accommodated in the magazine 24 obliquely with respect to the sub scanning direction is linearly transported as it is to be supplied to the predetermined recording position, where thermal recording is performed. In other words, the thermal printer 10 performs thermal recording while the recording material A is transported in the sub scanning direction with its lateral edges skewed with respect to the sub scanning direction as shown in FIG. 3.

Therefore, the lateral edges of the recording material A which come into contact with the glaze 66*a* of the thermal head 66 successively change in position little by little in the main scanning direction, and hence the lateral edges of the recording material A do not contact only a part of the glaze 66*a*, which prevents dirt from adhering to or depositing onto a part of the glaze 66*a*.

Accordingly, in the present invention, occurrence of streaky density unevenness that may be noticed in the transport direction due to a decrease in the amount of heat resulting from dirt adhered to or deposited onto a part of the glaze 66*a* can be prevented to obtain a thermally recorded, high-quality image having no streaky density unevenness.

As described above, the illustrated thermal printer 10 detects the lateral edges (ends in the main scanning direction) of the recording material A with the line sensor 80, so that the heating elements in the area corresponding to the inside of the lateral edges of the recording material A are only actuated to perform proper thermal recording, and useless heating of the heating elements is also positively prevented.

The type of a print to be created with the thermal printer 10 of the present invention is not particularly limited, and a bordered print whose periphery is blank or a borderless print having no blank periphery (margin) may be created. However, the borderless print is more preferable in the present invention because image is recorded on the recording material A in a slightly oblique manner and users less readily notice the obliquely recorded image in the borderless print.

In the thermal printer 10 of the present invention, there is no particular limitation on the angle that the lateral edges form with respect to the sub scanning direction as long as the lateral edges are skewed with respect to the sub scanning direction. According to the study made by the inventor of the present invention, the lateral edges are preferably skewed so that the distance as shown by "x" in FIG. 3 formed between the position at which the forward corner of one lateral edge of the recording material A passes under the thermal head 66 and the position at which the rear corner thereof passes under the thermal head 66 (i.e., the shift amount "x") is at least 1 mm. In a shift amount "x" of at least 1 mm, dirt can be advantageously prevented from adhering to or depositing onto only a part of the thermal head 66. It is preferable to set the upper limit of the shift amount "x" in a range in which a high-quality thermal print can be obtained without causing any marked quality deterioration due to an image obliquely formed on the recording material A. Whether or not an obliquely formed image causes quality deterioration is determined greatly depending on the type of the image and the feeling a viewer has, and it is difficult to precisely determine the shift amount. However, as a result of the observations made by the inventor of the present invention, it has been found that, in the case of using a film with a size of 356 cm×432 cm, an obliquely formed image inevitably causes quality deterioration in a shift amount exceeding 3 mm. In other words, when a film with a size of 356 cm×432 cm is used, the shift amount "x" is preferably not more than 3 mm and more preferably 1 mm to 2 mm.

In the embodiment described above, the recording material A is obliquely accommodated in the magazine 24 and is supplied as it is to the predetermined recording position (at which it is nipped between the thermal head 66 (glaze 66*a*) and the platen roller 60 while being transported) so that the recording material A supplied to the recording position is skewed with respect to the sub scanning direction and is transported in the sub scanning direction to thereby perform thermal recording.

This is not the sole method of the invention to skew the lateral edges of the recording material A with respect to the sub scanning direction, and various methods can be used.

Figure 4:
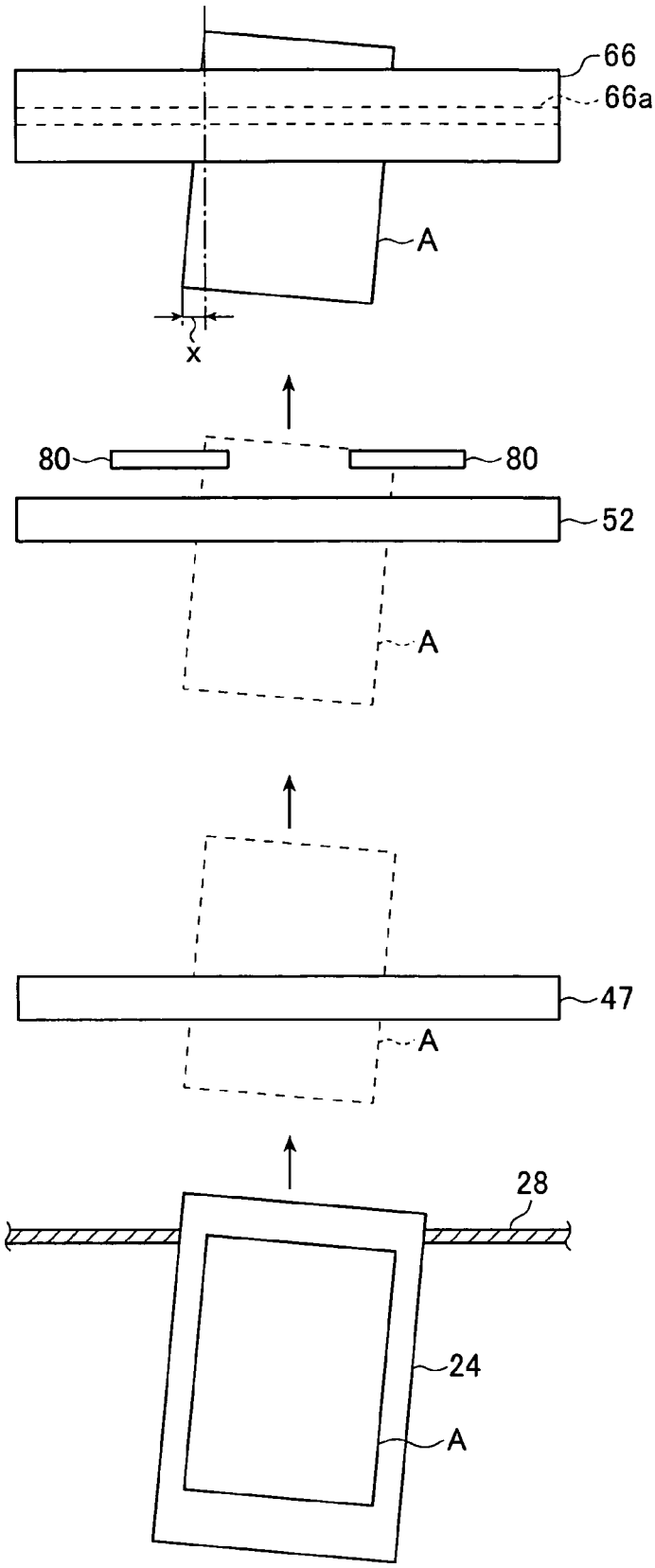
FIG. 4 is a plan view illustrating another example of the sequential movement of the thermal recording material skewed and transported in the thermal printer of the present invention.

For example, the recording material A may be supplied to the recording position with its lateral edges skewed with respect to the sub scanning direction as shown in FIG. 4 by obliquely loading the magazines 24 into the first and second loading sections 12, 14 of the thermal printer 10 through the inlets (slots) 30*a*, 30*b* formed by, for example, a method in which the inlets (slots) 30*a*, 30*b* for loading the magazines 24 in which the recording material A is accommodated straight in a normal state are obliquely formed. Also in this case, the respective inlets 30*a*, 30*b* of the first and second loading sections 12, 14 and the magazines 24 loaded into these loading sections 12, 14 through the inlets 30*a*, 30*b* constitute the means for skewing the recording material A according to the present invention.

As in the above embodiment shown in FIG. 3, this method is also capable of thermal recording as shown in FIG. 4 on the recording material A supplied to the recording position with its lateral edges skewed with respect to the sub scanning direction while it is transported in the sub scanning direction.

Accommodation of the recording material A in the magazine 24 and its loading into the thermal printer 10 may be performed straight as usual and a means for changing the angle formed between the recording material A and the transport direction may be provided midway along the transport path extending from the magazine 24 to the recording position.

Figure 5:
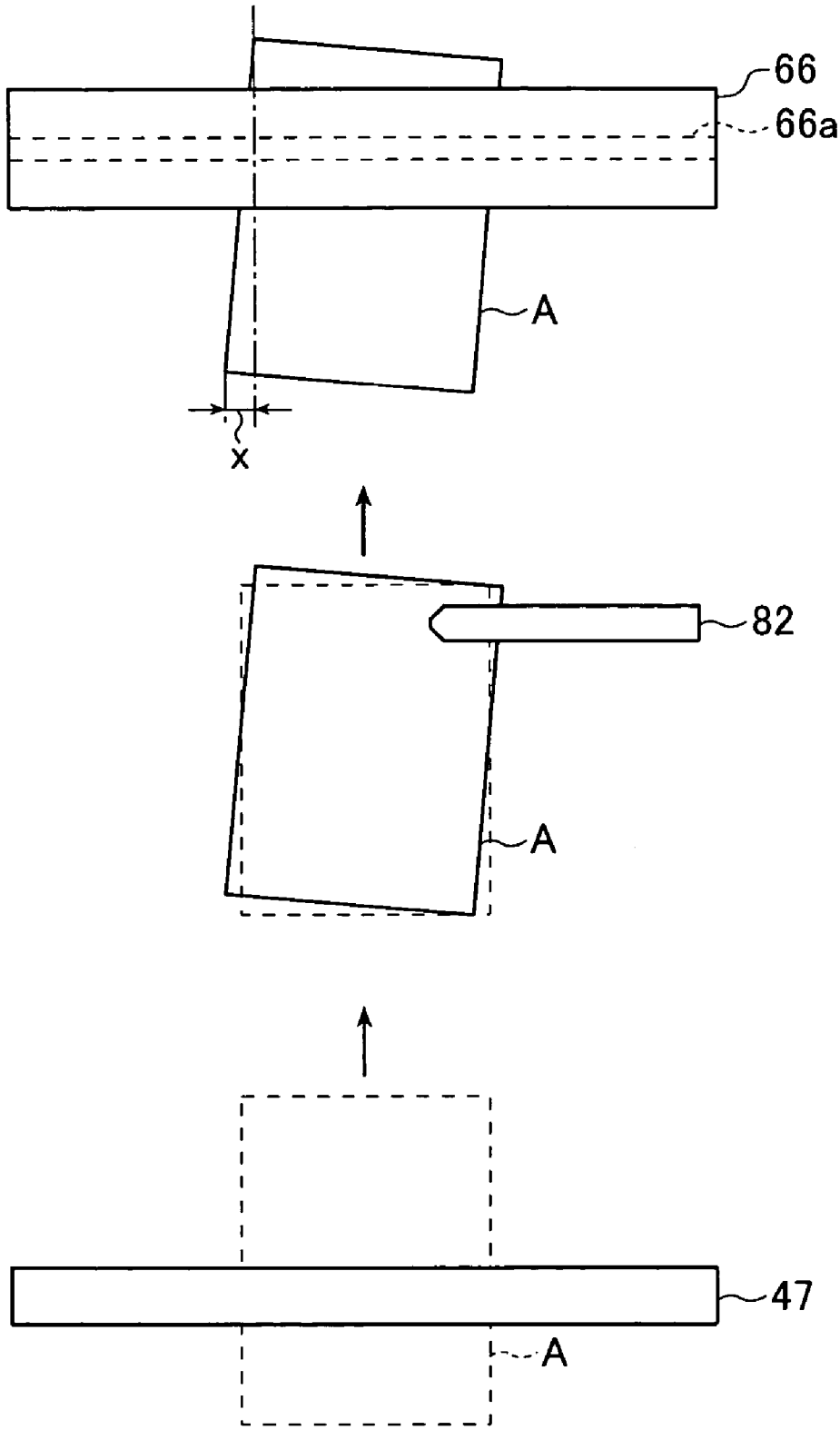
FIG. 5 is a plan view illustrating still another example of the sequential movement of the thermal recording material skewed and transported in the present invention.

For example, holding means 82 for nipping and holding the vicinity of one lateral edge of the recording material A may be provided midway along the transport path as shown in FIG. 5 so that the recording material A being transported can be held at a position outwardly deviated from the center of the recording material A in the main scanning direction, pivoted about the holding point by a predetermined angle and transported downstream to enable the recording material A to be supplied to the recording position with its lateral edges skewed with respect to the sub scanning direction and to be subjected to thermal recording while it is transported in the sub scanning direction.

Figure 6:
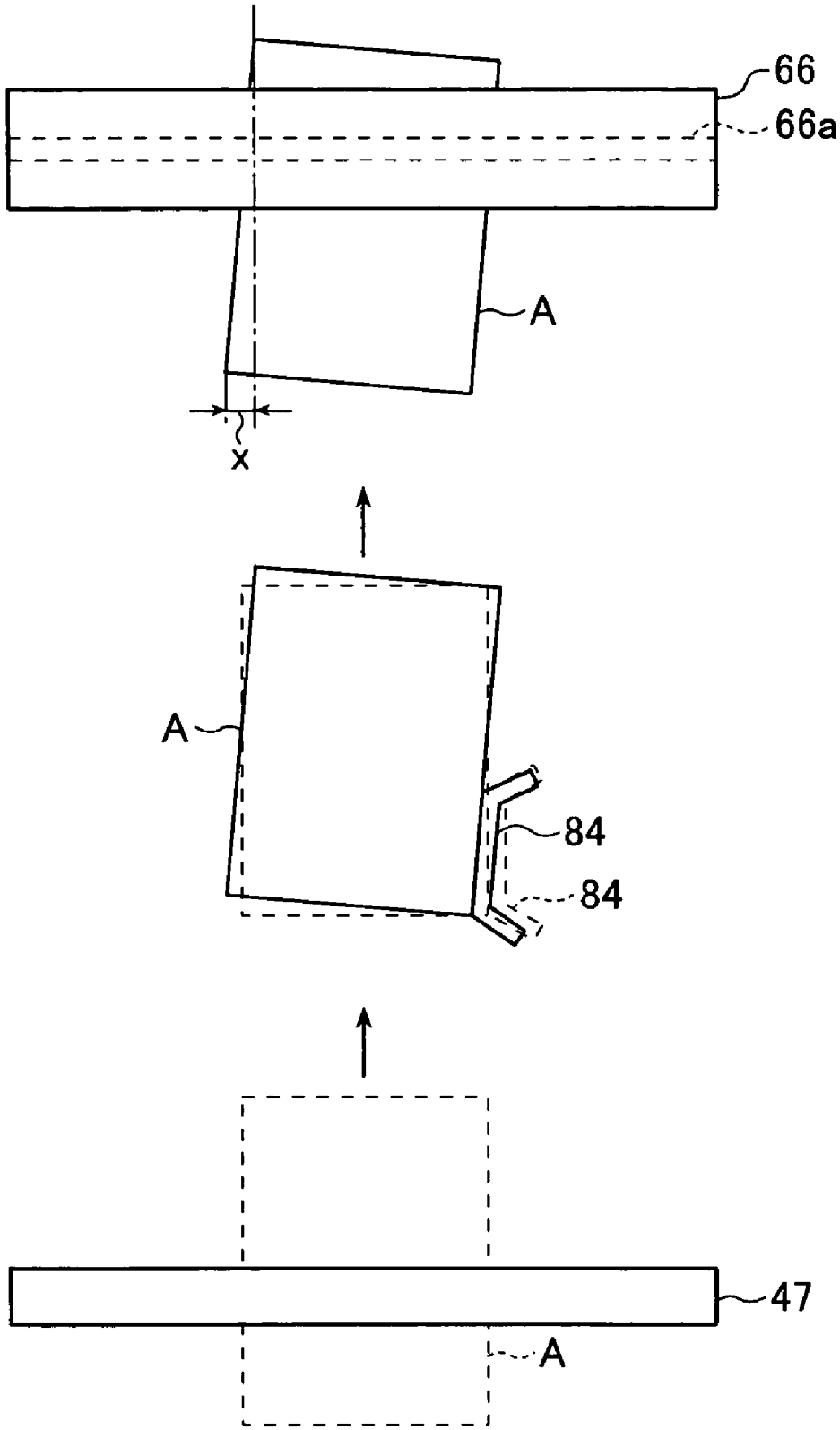
FIG. 6 is a plan view illustrating yet another example of the sequential movement of the thermal recording material skewed and transported in the present invention.

A transport guide 84 which regulates the position of the recording material A on the transport path through its contact with a lateral edge of the recording material A and which guides the recording material A may be provided midway along the transport path as shown in FIG. 6. In this case, at least a part of the transport guide 84 is moved in the main scanning direction toward the center of the transport path to press and move on the transport path a portion near the forward end or rear end of the recording material A being transported and to turn the recording material A being transported by a predetermined angle on the transport path such that the thus skewed recording material A is transported downstream to be supplied to the recording position with its lateral edges skewed with respect to the sub scanning direction to enable thermal recording while the recording material A is transported in the sub scanning direction. The whole of the transport guide 84 may be turned and skewed with respect to the transport path (sub scanning direction) to turn the recording material A being transported by a predetermined angle on the transport path to make it skew.

If the recording material A can form a predetermined angle with respect to the transport direction in the above cases, the recording material A may be pivoted or turned while it is transported or in the state in which its transport is stopped.

The thermal printer of the present invention has been described above in detail but the present invention is in no way limited to the stated embodiments and various improvements and modifications can of course be made without departing from the spirit and scope of the invention.

For example, in the thermal printer 10 of the present invention, the angle at which the recording material A is skewed with respect to the transport direction may be changed in accordance with the size of the recording material A or may remain unchanged irrespective of the size of the recording material A.

What is claimed is:

1. A thermal printer comprising:

a thermal head which has heating elements arranged in a main scanning direction;

transport means for transporting a thermal recording material in a sub scanning direction perpendicular to the main scanning direction; and skewing means for skewing said thermal recording material so that its ends in the main scanning direction form an angle with respect to the sub scanning direction at a predetermined recording position, wherein said thermal recording material having been skewed by said skewing means so that its ends in the main scanning direction form said angle with respect to the sub scanning direction is supplied to said recording position, where thermal recording on said thermal recording material is performed with said thermal head while said thermal recording material which remains skewed is transported in the sub scanning direction by said transport means.

2. The thermal printer according to claim 1, further comprising detection means for detecting the ends of said thermal recording material in the main scanning direction, wherein the recording position on said thermal recording material is controlled based on detection results obtained by the detection means.

3. The thermal printer according to claim 1, wherein a distance in the main scanning direction between a position at which a forward corner of one of the ends of said thermal recording material passes under the arranged heating elements and a position at which a rear corner thereof passes under the arranged heating elements is at least 1 mm.

4. The thermal printer according to claim 1, further comprising a loading section for loading said thermal recording material, wherein said skewing means loads said thermal recording material into the loading section obliquely with respect to the sub scanning direction to supply the thermal recording material to said recording position with its ends in the main scanning direction skewed with respect to the sub scanning direction.

5. The thermal printer according to claim 4, wherein said loading section includes a generally rectangular magazine in which rectangular sheets of the thermal recording material are obliquely accommodated and an inlet for loading said magazine parallel to said sub scanning direction, and wherein said skewing means skews said thermal recording material to be accommodated in said magazine so that its ends in the main scanning direction are skewed with respect to the sub scanning direction when said magazine is loaded through said inlet.

6. The thermal printer according to claim 4, wherein said loading section includes a generally rectangular magazine in which rectangular sheets of the thermal recording material are properly accommodated without being skewed and an inlet for loading said magazine in a skewed state, and wherein said skewing means loads said magazine through said inlet in the skewed state so that the ends in the main scanning direction of said thermal recording material accommodated in said magazine are skewed with respect to the sub scanning direction.

7. The thermal printer according to claim 1, further comprising holding means which holds the thermal recording material at a point outwardly deviated from its center in the main scanning direction and which is provided midway along a transport path of the thermal recording material extending to said recording position, wherein said skewing means uses said holding means to temporarily hold said thermal recording material being transported by said transport means to supply said thermal recording material to said recording position with its ends in the main scanning direction skewed with respect to the sub scanning direction.

8. The thermal printer according to claim 1, wherein a transport guide which regulates a position of said thermal recording material in the main scanning direction and which guides said thermal recording material in the sub scanning direction is further provided midway along the transport path of said thermal recording material extending to said recording position, wherein at least a part of said transport guide is movable in said main scanning direction toward a center of the transport path, and wherein said skewing means moves said at least a part of the transport guide in said main scanning direction toward the center of the transport path to move on said transport path a portion near a forward end or rear end of said thermal recording material being transported on said transport path so that said thermal recording material is supplied to said recording position with its ends in the main scanning direction skewed with respect to the sub scanning direction.

9. A thermal printer comprising:

a thermal head which has heating elements arranged in a main scanning direction, wherein thermal recording is performed on a thermal recording material with said thermal head while transporting said thermal recording material in a sub scanning direction perpendicular to the main scanning direction at a predetermined recording position, wherein said thermal recording material having been skewed so that its ends in the main scanning direction form an angle with respect to the sub scanning direction at a predetermined recording position is supplied to said recording position, and wherein the thermal recording on said thermal recording material is performed with said thermal head while said thermal recording material which remains skewed is transported in the sub scanning direction.

* * * * *